United States Patent [19]

Yatsuyanagi et al.

[11] Patent Number: 5,049,483

[45] Date of Patent: Sep. 17, 1991

[54] DIRECT POSITIVE SILVER HALIDE PHOTOGRAPHIC LIGHT-SENSITIVE MATERIAL AND A PROCESSING METHOD THEREFOR

[75] Inventors: Naoko Yatsuyanagi; Tsuyoshi Mitsuhashi, both of Tokyo, Japan

[73] Assignee: Konica Corporation, Tokyo, Japan

[21] Appl. No.: 532,946

[22] Filed: Jun. 4, 1990

[30] Foreign Application Priority Data

Jun. 8, 1989 [JP] Japan ..... 1-147923
Jun. 29, 1989 [JP] Japan ..... 1-168640

[51] Int. Cl.[5] ..... G03C 1/485

[52] U.S. Cl. ..... 430/597; 430/510; 430/596; 430/606; 430/611; 430/613; 430/631; 430/633; 430/635; 430/636; 430/567; 430/940; 430/963

[58] Field of Search ..... 430/596, 597, 940, 611, 430/613, 606, 636, 635, 633, 631, 963, 510, 567

[56] References Cited

U.S. PATENT DOCUMENTS

| | | | |
|---|---|---|---|
| Re. 28,258 | 12/1974 | Gilman et al. | 96/101 |
| 3,501,310 | 3/1970 | Illingsworth et al. | 96/106 |
| 3,505,070 | 4/1970 | Litzerman et al. | 96/102 |
| 3,510,348 | 5/1970 | Brooks et al. | 117/201 |
| 3,816,121 | 6/1974 | Shiba et al. | 96/97 |
| 4,059,450 | 11/1977 | Vanassche et al. | 96/101 |
| 4,814,263 | 3/1989 | Hine | 430/567 |
| 4,891,307 | 1/1990 | Mukunoki et al. | 430/527 |

FOREIGN PATENT DOCUMENTS

| | | |
|---|---|---|
| 58-217928 | 12/1983 | Japan . |
| 61-132944 | 6/1986 | Japan . |
| 62-109045 | 5/1987 | Japan . |
| 62-246046 | 10/1987 | Japan . |

*Primary Examiner*—Charles L. Bowers, Jr.
*Assistant Examiner*—Tanis L. Dote
*Attorney, Agent, or Firm*—Jordan B. Bierman; Bierman and Muserlian

[57] ABSTRACT

There is disclosed a direct positive silver halide light-sensitive material which can be processed in ultra-rapid processing and have a higher sensitivity, a lower Dmin, an excellent antistatic property and less flactuation of the properties in storing. The light-sensitive material contains an electron-accepting compound in a silver halide emulsion layer, and a fluorinated surfactant and/or at least one of the compounds represented by Formulas I-a to II-b in a photographic component layer:

Formula I-a

Formula I-b

Formula II-a

Formula II-b wherein $R_1$ to $R_4$ represent independently a hydrogen atom, a lower alkyl group, an alkoxy group, a carboxy group, an alkoxycarbonyl group, a sulfo group, a halogen atom, and a nitro group, provided that at least one of $R_1$ and $R_2$ is a carboxy group, an alkoxycarbonyl group or a sulfo group.

19 Claims, No Drawings

DIRECT POSITIVE SILVER HALIDE PHOTOGRAPHIC LIGHT-SENSITIVE MATERIAL AND A PROCESSING METHOD THEREFOR

FIELD OF THE INVENTION

The present invention relates to a silver halide photographic light-sensitive material, and more particularly to an antistatic direct positive silver halide photographic light-sensitive material having a high sensitivity and less fog (minimum density) even when processed rapidly.

BACKGROUND OF THE INVENTION

In general, when a silver halide photographic light-sensitive material is exposed to a light having spectral regions to which the light-sensitive material is sensitive and then developed, an image density increases as an exposure increases, and reaches the maximum value at a certain exposure, and if the exposure further increases, there occurs a phenomenon that the density decreases. This phenomenon is called solarization.

Therefore. where a silver halide emulsion is optically or chemically given an appropriate fog beforehand so that the density reaches the maximum value, the solarization occurs by exposure, whereby a positive image can be directly obtained. A light-sensitive material utilizing such the reversal phenomenon is called a fog nucleus destruction-type direct positive silver halide photographic light-sensitive material (hereinafter referred to as a direct positive light-sensitive material).

Direct positive light-sensitive materials of this type are used for making copies from various photographs.

In recent years, the consumption amount of silver halide photographic light-sensitive materials continues to increase and results in increasing of the processing quantity of light-sensitive materials. To raise the processing efficiency, there has been a strong demand for further more rapid processing.

The above tendency is the case also in the field of X-ray light-sensitive materials; strict enforcement of periodical medical checks leads to rapidly increasing the number of diagnoses, and more accurate diagnoses lead to increase in the number of checking items, which results in more and more increase in a radiographing frequency.

A rapid processing is demanded as well for the direct positive light-sensitive material, and in order to meet this demand, it is necessary not only to automate the diagnoses including radiographing and transport of film but also to provide a rapid processability to the light-sensitive material.

The direct positive light-sensitive material, however, has the problem that the sensitivity is liable to lower when it is subjected to such rapid processing that the overall processing time is 20 to 60 seconds.

The decrease in the sensitivity can be prevented by increasing an amount of coated silver, but it generates such negative effects as increasing of a film production cost and insufficient fixation, washing and drying in processing of film.

Accordingly, in order to provide the rapid processability to the direct positive light-sensitive material. it is necessary to develop a technique for reducing an amount of silver halide without lowering the sensitivity and maximum density. The method for saving silver and maintaining the sensitivity high is described in U.S. Pat. Nos. 2,996,382 and 2,178,382, in which a light-sensitive material having the high sensitivity, contrast and covering power can be prepared by incorporating a surface latent image-type and internal fog-type silver halide grains into the same layer.

The above light-sensitive material, however, has the disadvantage that when it is subjected to a high-speed processing by an automatic processor whose total processing time is from 20 to 120 seconds, a minimum density (fog) is increased and a graininess is deteriorated.

It is known that the minimum density and graininess can be improved by adding various additives to an emulsion or a developer and increasing a gelatin amount, but either is liable to deteriorate the sensitivity, contrast and maximum density.

Most of light-sensitive materials consisting of an insulating support and photographic component layers are liable to accumulate electrostatic charge, which brings about serious problem that static marks are generated on a film and the film is liable to attract dust onto the surface thereof.

The similar problem is caused as well in the direct positive light-sensitive material. Especially in reproducing X-ray photographs, the presence of dust is liable to lead to a wrong diagnosis in medical examinations.

There are a number of conventional antistatic techniques for photographic films for general use as described in Japanese Patent Examined Publication Nos. 8742/1972, 4853/1974, 1617/1981, 19406/1982 and 43729/1983, Japanese Patent Publication Open to Public Inspection (hereinafter referred to as Japanese Patent O.P.I. Publication) Nos. 10722/1974, 16525/1975 and 32322/1976.

It has been found that an increased conductivity of a film surface with a nonionic surfactant effectively prevents the film from attracting dust.

However, where the above nonionic surfactane is applied to a direct positive silver halide emulsion produced by methods described in Japanese Patent Examined Publication No. 3938/1975 and Japanese Patent O.P.I. Publication Nos. 43627/1974 and 91632/1974, storage Of the light-sensitive material under a high temperature/moisture condition is liable to cause deterioration of the maximum density thereof.

Generally, there are known two coating methods: one is a continuous coating method in which a silver halide emulsion is continuously prepared and coated: and the other is a batch coating method in which a prescribed quantity of an emulsion is prepared and stored in a storage tank before coating.

The continuous coating method has the advantage that there is no step of storing an emulsion, but continuous coating over a long period of time tends to cause a fluctuation in photographic characteristics in the same lot.

To avoid this problem, it is important to control the adding rates of the additives to the emulsion, which necessitates a very severe process control and maintenance of a complicated and precise control unit and an in-line addition equipment.

On the other hand, the batch coating method, in which a prescribed quantity of an emulsion containing prescribed amounts of additives is prepared and stored while keeping a temperature constant with stirring, has the advantage that there is little fluctuation in photographic characteristics in the same lot to thereby enable to provide uniform quality light-sensitive materials.

The batch coating method, however, causes considerable fluctuation and deterioration of photographic characteristics attributable to storing the emulsion over a long period of time, such as an increase or decrease in the sensitivity and fogging, and such phenomenon becomes conspicuous as the sensitivity of an emulsion increases. which means that the maximum density decreases and the minimum density increases.

There have been reported a number of techniques to use various stabilizers and antifoggants for preventing fluctuation of photographic characteristics attributable to change in the emulsion quality in the course of manufacturing process.

There are known conventional techniques described in Japanese Patent O.P.I. Publication Nos. 217928/1983, 103233/1988 and 61046/1987, but these are insufficient for solving the above problems and providing the light-sensitive materials with super rapid processability.

SUMMARY OF THE INVENTION

It is a first object of the present invention to provide a direct positive silver halide photographic light-sensitive material which is suitable for super-rapid processing and capable of forming an image having little fog.

It is a second object of the invention to provide a direct positive light-sensitive material having an excellent antistatic characteristic.

It is a third object of the invention to provide a direct positive light-sensitive material having no sensitivity fluctuation and no increased fog attributable to storing of an emulsion and capable of providing stable photographic characteristics.

It is a fourth object of the invention to provide a method for processing an imagewise-exposed direct positive light-sensitive material in the whole processing time of not less than 20 seconds and less than 60 seconds.

The above objects of the invention are accomplished by: (1) a direct positive silver halide photographic light-sensitive material comprising a support having on at least one side thereof the photographic component layers including a silver halide emulsion layer, wherein the silver halide emulsion layer contains an electron-accepting organic compound: and at least one of the photographic component layers contains at least one selected from the group consisting of a fluorinated surface active agent and at least one of the compounds represented by the following Formulas I-a to II-b:

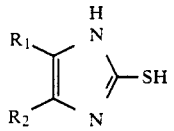

Formula I-a

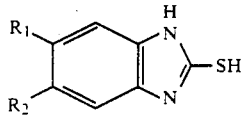

Formula I-b

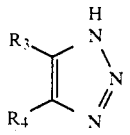

Formula II-a

-continued

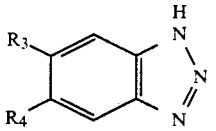

Formula II-b wherein $R_1$, $R_2$, $R_3$ and $R_4$ each represent a hydrogen atom, a lower alkyl group, an alkoxy group, a carboxy group, an alkoxycarbonyl group, a sulfo group, a halogen atom and a nitro group, provided that at least one of $R_1$ and $R_2$ is a carboxy group, an alkoxycarbonyl group or a sulfo group: and (2) a method in which the light-sensitive material is processed in the whole processing time of not less than 20 seconds and less than 60 seconds.

DETAILED DESCRIPTION OF THE INVENTION

The direct positive silver halide emulsion used in the invention may be any silver halide containing silver iodide, such as silver iodochloride, silver iodobromide and silver iodochlorobromide; especially. silver iodobromide is preferred from the standpoint of a higher sensitivity.

An average silver iodide content of the silver halide grain is 0.05 to 10 mole %, and preferably 0.5 to 8 mole %. There may exist locally in the grain a portion containing silver iodide of at least 20 mole %.

The grain may be of an isotropic form such as a cube, an octahedron and a tetradecahedron, or of an anisotropic form such as a tabular crystal and a potato-shaped crystal.

The silver halide emulsion used in the invention may be monodispersed or polydispersed, and may be a mixture of two more kinds of the emulsions.

Where silver halide is of a core/shell type, a silver halide composition of the core is silver iodide, silver bromoiodide or silver bromochloroiodide, preferably silver bromoiodide containing silver bromide of 0 to 99 mol %.

A crystal shape thereof may be any of a cube, an octahedron, a tetradecahedron, a sphere and a potate shape, and may be monodispersed or polydispersed.

A silver halide composition of the shell may be anyone as long as it has a smaller solubility product than that of the core, and it is preferably a silver bromide or silver bromoiodide containing silver iodide of not more than 6 mol %.

A molar ratio of the shell to the core is 1:100 to 10:1, preferably 1:10 to 5:1.

A crystal shape of the core/shell silver halide grains may be any of a cuble, an octahedron, a tetradecahedron, a shere and a potato shape. A grain size thereof is 0.1 to 2.0 μm, preferably 0.15 to 1.0 μm.

The silver halide emulsion used in the invention may contain in the grains an inorganic desensitizer including water-soluble metal salts of Group VIII, such as a rhodium salt and an iridium salt.

An adding amount of the salt is preferably to $10^{-8}$ to $10^{-2}$ mole, and more preferably $10^{-5}$ to $10^{-3}$ mole per mole of silver halide.

In the invention, an electron-accepting organic compound is used in order to provide a satisfactory positive image. This compound is useful for preventing the formation and growth of a silver nucleus between photoelectron and silver ions.

The electron-accepting compound used in the invention is such that the total of a cathode polarograph half-wave potential (Ea) and an anode polarograph half-wave potential (Ec) becomes positive. Such compound spectrally sensitizes the silver halide emulsion at least in a wavelength region of more than 480 mμ, and normally 480 mμ to 800 mμ. The compound is capable of spectrally sensitizing an emulsion so that, when the emulsion is exposed through Wratten No. 16 and No. 35+38A filters to a tungsten light, the proportion of its minus blue light relative speed to its blue light relative speed is more than 7, preferably more than 10, and is called a spectrally sensitive electron acceptor.

Particularly useful electron-accepting compounds for the direct positive silver halide emulsion of the invention are cyanine dyes, particularly the imidazoquinoxaline dyes described in Belgian Patent No. 660253 laid Open On March 15, 1965. Very good results can be obtained when using a cyanine dye containing an indole nucleus having an aromatic substituent in a 2-position. These dyes contain a desensitization nucleus in addition to the indole nucleus.

The preferred spectrally sensitive electron-accepting compound used in the invention is represented by the following Formula III:

Y−L−Q wherein L represents a methine group having 2 to 3 carbon atoms: Y represents an indole nucleus which has an aromatic substituent in a 2-position and is linked through the carbon atom in a 3-position with the methine group: Q is an organic heterocyclic nucleus, provided that when L is a methine group having 2 carbon atoms, Q represents a desensitization nucleus to provide an asymmetric dimethine cyan dye, while when L is a methine group having 3 carbon atoms, Q represents an indole nucleus which has an aromatic substituent in a 2-position and is linked through the carbon atom in a 3-position with the methine group. The particularly useful desensitization nucleus when L is a methine group having 2 carbon atoms is a imidazo-[4,5b]-quinoxaline nucleus which is linked through the carbon atom in a 2-position with the methine group.

The Spectrally sensitive electron-accepting compounds preferably used in the invention is a dimethine cyanine dye represented by the following Formula IV:

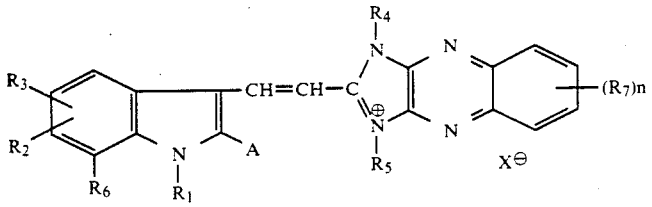

wherein A is an aromatic nucleus, such as a phenyl nucleus which may have various substituents including an alkyl group, an alkoxy group, a halogen atom and an aryl group, and a heterocyclic aromatic nucleus having preferably 5 to 6 carbon atoms, wherein the hetero atom is preferably nitrogen, sulfur or oxygen: $R_2$ and $R_3$ each represent a hydrogen atom, a halogen atom, an alkyl group and an alkoxy group, provided that $R_2$ and $R_3$ may combine with each other to form an aromatic ring having 6 carbon atoms: $R_1$ is an alcohol residue, such as an alkyl group having preferably 1 to 8 carbon atoms, a sulfoalkyl group, a sulfatoalkyl group, a carboxyalkyl group; $R_4$ and $R_5$ each are an alcohol residue, such as an alkyl group having preferably 1 to 18 carbon atoms, a sulfoalkyl group, a sulfatoalkyl group, a carboxyalkyl group, a hydroxyalkyl group, an allyl group, an alkenyl group, an alkynyl group, a cycloalkyl group, a dialkylaminoalkyl group, and an aryl group; $R_6$ is the same as those defined for $R_2$; $R_7$ is a halogen atom or $NO_2$; n is an integer of zero to 3; X is an anion, preferably an acid anion such as chloride, bromide, iodide, p-toluene-sulfonate, thiocyanate, sulfonate, methylsulfate, ethylsulfate and perchlorate.

The particularly useful spectrally sensitive electron acceptors are represented by the following Formula IVa:

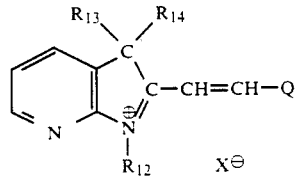

wherein $R_{12}$, $R_{13}$ and $R_{14}$ each represent an alkyl group and an aryl group; X is the same as those defined in Formula IV; and Q represents $-CH{=}Q_1$ wherein $Q_1$ is a densensitization nucleus to form a trimethine cyanine dye, such as a 6-nitrobenzothiazole nucleus, a 5-nitroindolenine nucleus, an imidazo[4,5b-]quinoxaline nucleus or a pyrrolo[2,3b]-pyrido nucleus represented by:

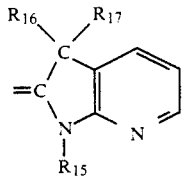

wherein $R_{15}$, $R_{16}$ and $R_{17}$ are the same as those defined for $R_{12}$, $R_{13}$ and $R_{14}$, respectively; further $Q_1$ represents a desensitization nucleus to form a dimethine cyanine dye, such as a pyrazole nucleus or an indole nucleus which has a substituent in a 2-position and is linked through the carbon atom at a 3-position with the methine group, represented by:

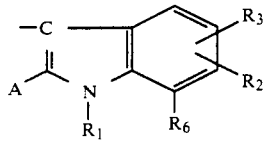

wherein A, $R_1$, $R_2$, $R_3$ and $R_4$ are the same as those defined in Formula IV.

Other useful spectrally sensitive electron acceptors are represented by the following Formula V:

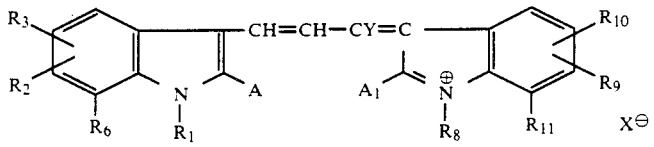

wherein X, A, $R_1$, $R_2$, $R_3$ and $R_6$ are the same as those defined in Formula IV; $A_1$, $R_8$, $R_9$, $R_{10}$ and $R_{11}$ are the same as those defined for A, $R_1$, $R_2$, $R_3$ and $R_6$, respectively; and Y is a hydrogen atom, an aryl group, an alkyl group, an alkoxy group or a heterocyclic aromatic group such as thiophene.

A symmetric imidazo[4,5b]quinoxaline trimethine cyanine dye in which each nucleus is linked through the carbon atom in a 2-position with the methine group is a useful electron acceptor for the invention.

Such dyes are represented by the following Formula VI:

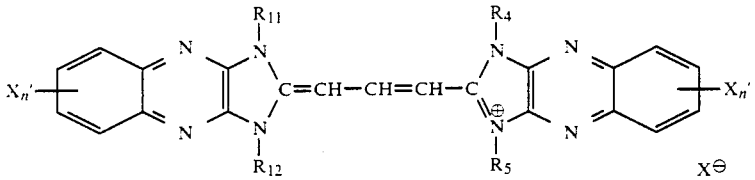

wherein X', $R_4$ and $R_5$ are the same as those defined in Formula IV; $R_{11}$ and $R_{12}$ are the same as those defined for $R_4$ and $R_3$, respectively: each X' is a halogen atom; and n is an integer of zero to 3.

The other electron acceptors are represented by the following Formula VII:

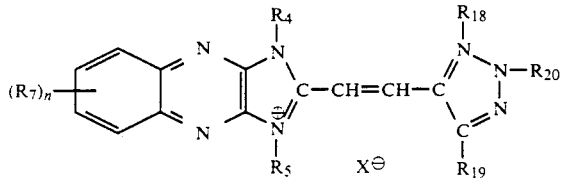

wherein $R_7$, n, $R_4$, $R_5$ and X are the same as those defined in Formula IV; $R_{18}$ and $R_{19}$ each are a hydrogen atom, an alkyl group having preferably 1 to 18 carbon atoms, an aryl group; and $R_{20}$ is the same as $R_4$.

Such dyes can be produced by conventional methods, for example, by refluxing a 2-alkylimidazo[4,5-b]quinoxalinium salt and pyrazole-4-carboxyaldehyde in an appropriate solvent such as acetic anhydride. A typical dye of this kind is 1,3-diallyl-2-[2-(3,5-dimethyl-1-phenyl -4-pyrazolyl)vinyl)imidazo[4,5-b]quinoxalinium iodide having the following chemical structure:

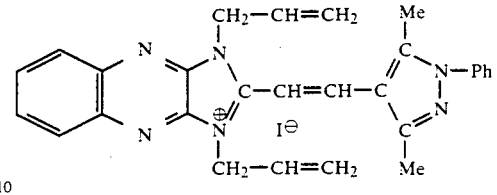

This dye can be produced by refluxing 1,3-diallyl-2-methylimidazo[4,5'b]quinoxalinium-p-toluene-sulfonate and 3,5-dimethyl-1-phenylpyrazole-4-carboxyaldehyde in acetic anhydride for about ten minutes.

The other useful spectrally sensitive electron acceptors are those cyanine and merocyanine dyes having a desensitizing substituent such as $NO_2$ on at least one nucleus, preferably two nuclei.

The other specific electron acceptors useful for the invention are cyanine dyes containing at least one halogen atom. The preferred cyanine dye of this kind has at least one methine group in which a hydrogen atom is substituted by a halogen atom such as chlorine, bromine and iodine.

The above halogenated cyanine dyes are represented by the following Formula VIII:

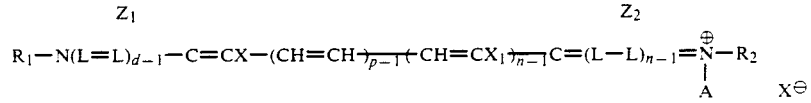

wherein $Z_1$ and $Z_2$ each are a group of non-metallic atoms necessary to complete a heterocyclic nucleus, a benzothiazole nucleus such as benzothiazole, 4-chlorobenzothiazole, 4-methylbenzothiazole, 5-bromobenzothiazole, 4-phenylbenzothiazole, and 4-methoxybenzothiazole; a naphthothiazole nucleus such as α-naphthothiazole and 5-methoxy-β-naphthothiazole, a benzoxazole nucleus such as benzoxazole, 5-chlorobenzoxazole, 5-methyl-benzoxazole, 5-phenylbenzoxazole. and 5-methoxybenzoxazole; a naphthoxazole nucleus such as α-naphthoxazole; a benzoselenazole nucleus such as benzoselenazole and 5-chlorobenzoselenazole; a naphthoselenazole nucleus such as α-naphthoselenazole; a quinoline nucleus including 2-quinoline, such as quinoline, 3-methylquinoline, 6-chloroquinoline, and, 6-hydroxyquinoline; an isoquinoline nucleus such as 1-isoquinoline; X and $X_1$ each are selected from hydrogen, chlorine, bromine and iodine atoms, provided that at least one of X and $X_1$ is a chlorine, bromine or iodine atom; $R_1$ and $R_2$ each are a alkyl group a sulfoalkyl group having 1 to 4 carbon atoms, and a carboxyalkyl group having 1 to 4 carbon atoms; A is an acid anion such as a chloride. bromide, iodide, p-toluene-sulfonate, thiocyanate, methyl sulfate, ethyl sulfate or perchlorate: and d, m, n and p each represent an integer of 1 or 2.

Other examples are phenosafranine, pinacryptol yellow, 5-m-nitrobenzylidene rhodanine, 5-m-nitrobenzylidene-3-phenyl rhodanine, 3-ethyl-5-m-nitrobenzylidene rhodanine, 3-ethyl-5'-(2,4-dinitrobenzylidene) rhodanine, 5-o-nitrobenzylidene-3-phenyl rhodanine, 1',3-diethyl-6-nitrothia-2'-cyanine iodide, 3,3'-diethyl-6,6'-dinitro-9-phenylthiacarbocyanine iodide, 2-(p-dimethylaminophenyliminomethyl)benzothiazole ethoethylsulfate, crystal violet, 3,3'-diethyl-6,6'-dinitrothiacarbocyanine ethylsulfate, 1',3-diethyl-6-nitrothia-2'-cyanine iodide, 1,3-diamino-5-methylphenadinium chloride, 4-nitro-6-chlorobenzotriazole, 3,3'-di-p-nitrobenzylthiacarbocyanine bromide, 3,3'-di-p-nitrophenylthiacarbocyanine iodide, 3,3'-di-o-nitrophenyl-thiacarbocyanine perchlorate, 3,3'-dimethyl-9-trifluoromethylthiacarbocyanine iodide, 9-(2,4-dinitrophenylmercapto)-3,3'-diethylthiacarbocy iodide, bis(4,6-diphenylpyryl-2)trimethinecyanine perchlorate, anhydro-2-p-dimethylaminophenyliminomethyl-6-nitro -3-(4-sulfobutyl)-benzothiazolium hydroxide, 1-(2-benzothiazol-yl)-2-(p-dimethylaminostyryl) -4,6-diphenylpyridinium iodide, 1,3-diethyl-5-[1,3-neopentylene -6-(1,3,3-trimethyl-2-indolin-ylidene) -2,4-hexadienylidene]-2-thiobarbital acid, 2,3,5-tri-phenyl-2H-tetrazolium chloride, 2-(4-iodophenyl)-3-(4-nitro-phenyl) -5-phenyl-tetrazolium chloride, 1-methyl-8-nitroquinolium methylsulfate, 3,6-bis[4-(3-ethyl-2-benzothiazolinylidene) -2-butenylidene]-1,2,4,5-cyclohexanetetron, 1,3-diallyl-2-[2-(3,5-dimethyl-1-phenyl -4-pyrazolyl)vinyl-]imidazo[4,5b]quinoxalinium iodode, 6-amino-1-methyl-2-[(1'-methyl -6'-quinolinium)vinyl]quinolinium dichloride and 4-(p-m-amyloxyphenyl)-2,6-di(p-ethylphenyl)-thiapyrylium perchlorate.

The above desensitizing dyes can be produced easily by the synthesis methods described in U.S. Pat. No. 2,930,694, Belgian Patent No. 660,253 and Japanese Patent Examined Publication No. 3938/1975, and also in accordance with the methods described in F. M. Hamer, 'The Cyanine Dyes and Related Compounds' published by Wiley in 1964.

The electron-accepting compounds used for the invention are not limited to the above external electron-accepting compounds, and may be the other ones. They may be used in combination with an internal electron acceptor such as a rhodium salt.

The electron-accepting compound is used in an amount of 10 mg to 2 g, and preferably 50 mg to 1 g per mole of silver halide.

The following are examples of the electron accepting-compound used in the invention.

1

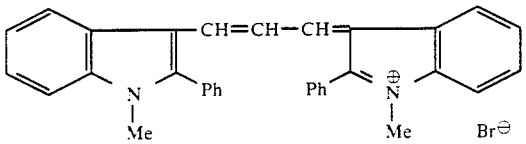

2

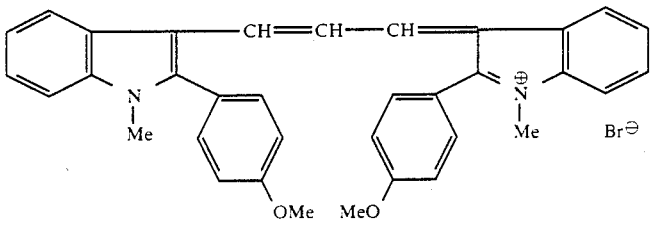

3

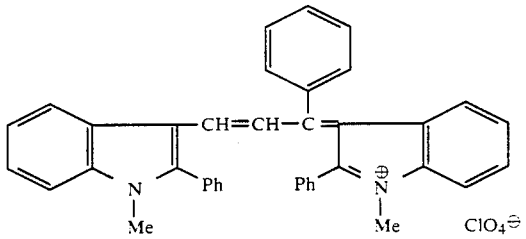

4

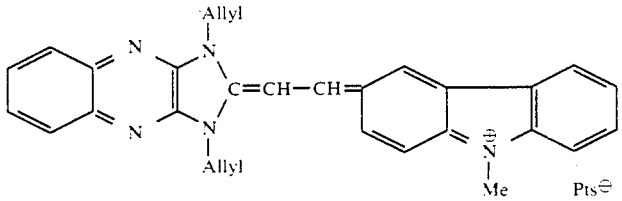

-continued
5
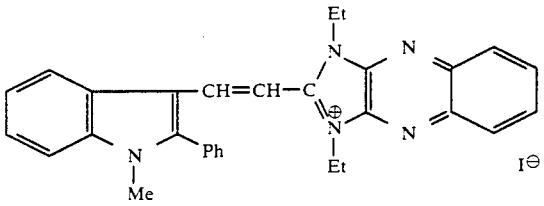
6
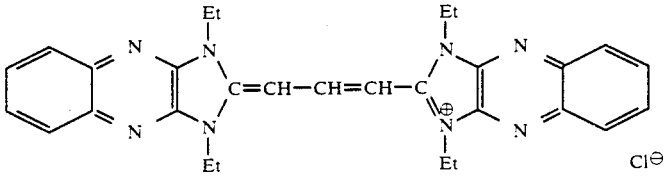
7
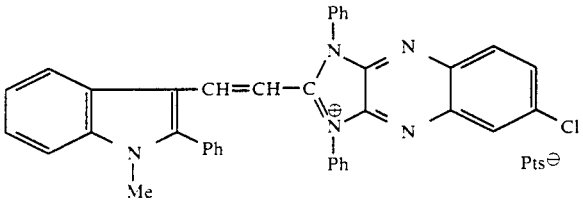
8
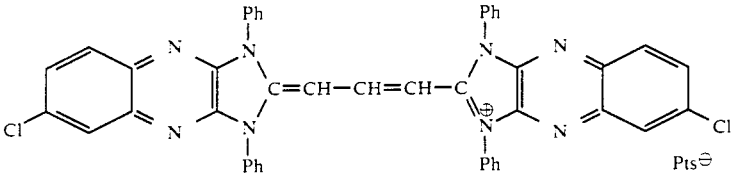
9
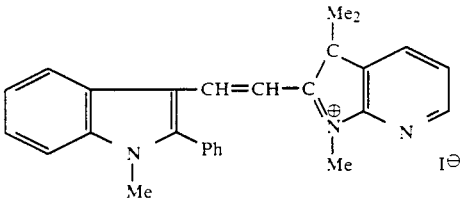
10
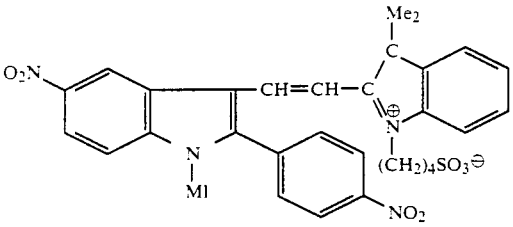
11
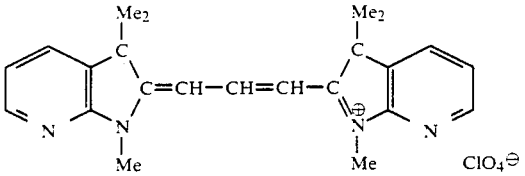
12
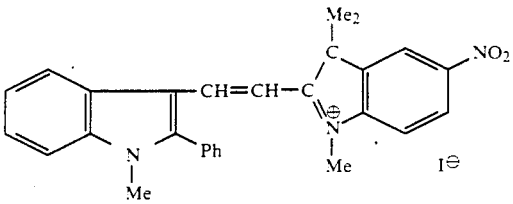

-continued

13

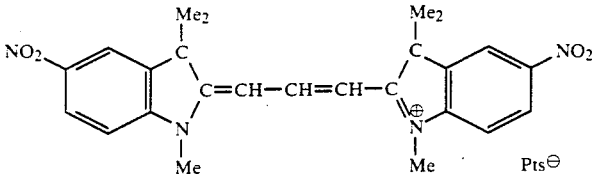

14

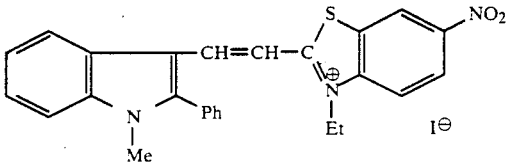

15

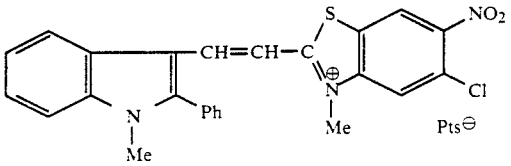

16

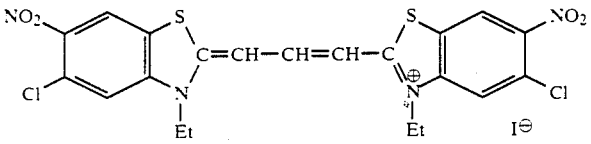

17

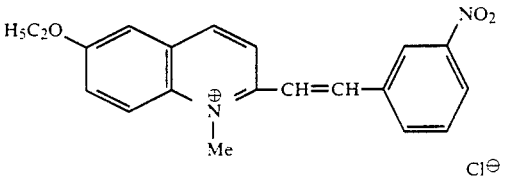

18

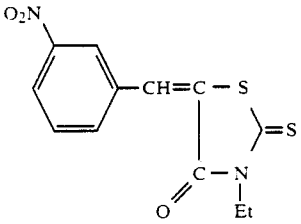

The fluorinated surface active agent added to at least one of the layers of the light-sensitive material of the invention is a nonionic, anionic or cationic one or one having a betaine structure, and has preferably a fluoroalkyl group having not less than 4 carbon atoms.

Examples of the surface active agent are anionic surface active agents having a sulfonic acid group or a salt thereof, a carboxylic acid group or a salt thereof, and phosphoric acid or a salt thereof; cationic or betaine-type surface acitive agents having an amine salts group, an ammonium salt group, a sulfonium salt group, a phosphonium salt group, and an aromatic amine salt group and nonionic surface active agents having a polyalkyleneoxide group and a polyglyceryl group.

The fluorinated surface active agents are described in U.S. Pat. Nos. 4,335,201 and 4,347,308, British Patent Nos. 1,417,915 and 1,439,402, Japanese Patent Examined Publication Nos. 26687/1977, 26719/1982 and 38573/1984, and Japanese Patent O.P.I. Publication Nos. 149938/1980, 48520/1979, 14224/1979, 200235/1983, 146248/1982 and 196544/1983.

The following are the examples of the fluorinated surface active agents.

| | |
|---|---|
| $C_8F_{17}SO_3K$ | F-1 |
| $C_7F_{15}COONa$ | F-2 |
| $C_8F_{17}CH_2CH_2OSO_3Na$ | F-3 |
| $C_8F_{17}SO_2N(C_3H_7)-CH_2COOK$ | F-4 |
| 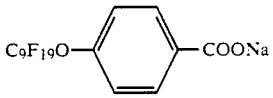 | F-5 |
| 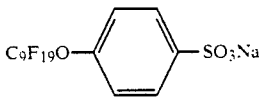 | F-6 |

-continued

F-7

$C_8F_{17}SO_2N(C_3H_7)(CH_2CH_2O)_4(CH_2)_4SO_3Na$

F-8

$C_8F_{17}SO_2N(C_3H_7)CH_2CH_2O-P(=O)(ONa)-ONa$

F-9

$C_{10}F_{21}COOCH_2CH(OH)CH_2SO_3Na$

F-10

$H(CF_2)_6CH_2OOC-CH_2$
$H(CF_2)_6CH_2OOC-CH(SO_3Na)$

F-11

$C_8F_{17}CH_2CH_2OOC-CH_2$
$C_4H_9OOC-CH(SO_3Na)$

F-12

$C_8F_{17}SO_2N(H)CH_2CH_2\overset{\oplus}{N}(CH_3)_2-CH_2COO^{\ominus}$

F-13

$C_8F_{17}SO_2N(H)CH_2CH_2CH_2OCH_2CH_2\overset{\oplus}{N}(CH_3)_2-CH_2COO^{\ominus}$

F-14

$C_8F_{17}SO_2N(H)CH_2CH_2CH_2OCH_2CH_2\overset{\oplus}{N}(CH_3)_2-CH_2CH_2COO^{\ominus}$

F-15

$C_7F_{15}CON(H)CH_2CH_2\overset{\oplus}{N}(CH_3)_2-CH_2COO^{\ominus}$

F-16

$H(CF_2)_{10}CON(CH_3)CH_2CH_2\overset{\oplus}{N}(CH_3)_2-CH_2COO^{\ominus}$

F-17

$C_8F_{17}SO_2N(H)CH_2CH_2\overset{\oplus}{N}(CH_3)_2-CH_2CH_2SO_3^{\ominus}$

F-18

$C_8F_{17}SO_2N(H)CH_2CH_2CH_2-\overset{\oplus}{N}(CH_3)_2(CH_2)_4SO_3^{\ominus}$

F-19

$C_8F_{17}SO_2N(H)CH_2CH_2\overset{\oplus}{N}(CH_2CH_2OH)_2-CH_2COO^{\ominus}$

F-20

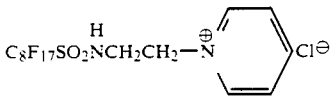

F-21

$C_8F_{17}SO_2N(H)CH_2CH_2\overset{\oplus}{N}(CH_3)_3\ I^{\ominus}$

-continued

F-22

$C_8F_{17}SO_2N(H)CH_2CH_2CH_2OCH_2CH_2\overset{\oplus}{N}(CH_3)_3$

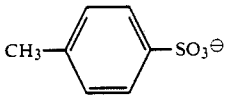

F-23

$C_7F_{15}CON(C_3H_7)CH_2CH_2\overset{\oplus}{N}(C_2H_5)_3\ Cl^{\ominus}$

F-24

$C_{10}F_{21}SO_2-N(CH_2CH_2OH)-CH_2CH_2CH_2\overset{\oplus}{N}(CH_3)_2CH_2CH_2OH\ Br^{\ominus}$

F-25

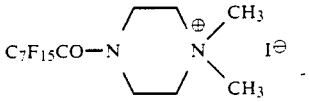

F-26

$C_7F_{15}COO(CH_2CH_2O)_{10}H$

F-27

$C_{10}F_{21}COO(CH_2CH_2O)_{10.5}H$

F-28

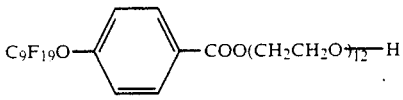

F-29

$C_8F_{17}SO_2N(CH_3)(CH_2CH_2O)_9H$

F-30

$C_8F_{17}SO_2N(C_{10}H_{21})(CH_2CH_2O)_{12.5}H$

F-31

$C_6F_{13}SO_2N(CH_2CH_2O)_nH(CH_2CH_2O)_mH$ $\quad n + m = 11.5$

F-32

$C_8F_{17}SO_2N(C_3H_7)(CH_2CH_2O)_{15}H$

F-33

$C_8F_{17}SO_2N(C_2H_5)CH(CH_3)CH_2-O)_3(CH_2CH_2O)_{13.5}H$

F-34

$C_8F_{17}CH_2CH_2O(CH_2CH_2O)_{12.5}H$

F-35

$C_8F_{17}SO_2N(C_3H_7)-CH_2COO(CH_2CH_2O)_{10.5}H$

F-36

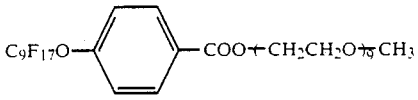

F-37

$C_9F_{19}O(CH_2CH_2O)_6CH_3$

-continued

F-38

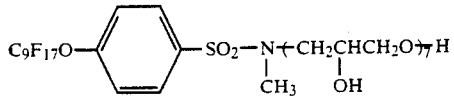

F-39

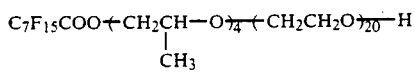

The above fluorinated surface active agent may be added to any of the photographic component layers including a light-sensitive silver halide emulsion layer and a non-light-sensitive layer such as a protective layer, an intermediate layer, a subbing layer and a backing layer.

More preferably, the agent is added to a light-sensitive emulsion layer, a protective layer and a backing layer. The agent may be added to the layers either on one side or both sides of a support.

The agent may be used in combination of two or more or with other surface active agents.

An addition amount thereof is 0.1 mg to 20 g, more preferably 0.5 mg to 100 mg/m$^2$.

It is preferable to use the above fluorinated surface active agent in combination with a polyoxyethyleneoxide surface active agent, of which examples are disclosed in Japanese Patent O.P.I. Publication Nos. 87826/1973, 3219/1976, 55521/1977, 129623/1978, 208743/1983 and 47948/1986.

The following are the examples of the polyoxy ethyleneoxide surface active agent.

2-1 $n\text{-}C_{10}H_{21}-O-(CH_2CH_2O)_{15}H$ 2-2 $n\text{-}C_{10}H_{21}-O-(CH_2CH_2O)_{15}SO_3Na$ 2-3 $n\text{-}C_{10}H_{21}-O-(CH_2CH_2O)_{15}CH_2-SO_3Na$ 2-4

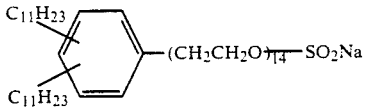

2-5

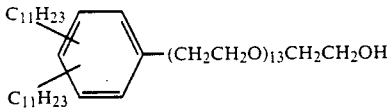

2-6

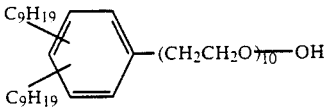

2-7 $n\text{-}C_{11}H_{23}CONH-(CH_2CH_2O)_{15}H$ 2-8

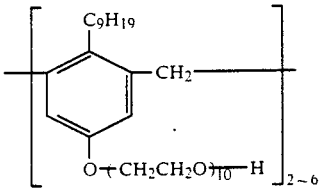

-continued 2-9

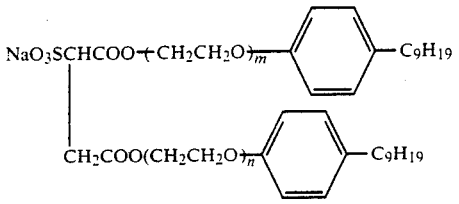

$\overline{m,n} = 10$ 2-10

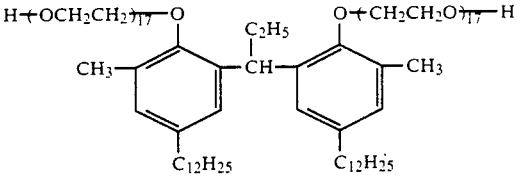

2-11

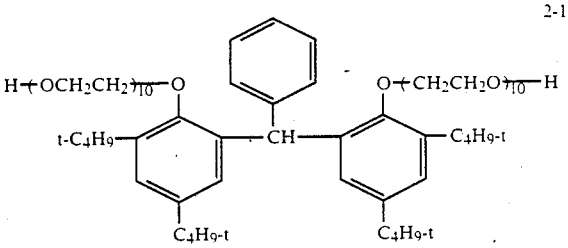

2-12

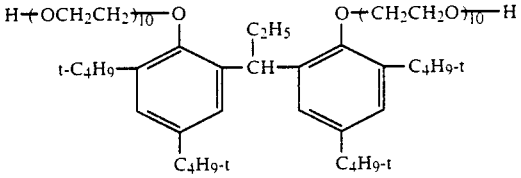

2-13 $C_{10}F_{21}CH_2-CH(CH_3)-CH_2-O-(CH_2CH_2O)_{18}-C_9H_{19}$ 2-14 $C_{10}F_{21}CH_2-CH(CH_3)-CH_2-O-(CH_2CH_2O)_{18}-SO_3Na$ 2-15 $C_{11}H_{23}CONH-(CH_2CH_2O)_{15}H$

The number of carbon atoms of the alkyl group in the lower alkyl, alkoxy and alkoxycarbonyl groups represented by $R_1$, $R_2$, $R_3$ and $R_4$ in the foregoing Formulas I-a and II-b is 1 to 4.

The following are the examples of the compound represented by Formula I-a and I-b:

I-1

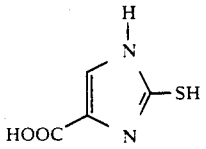

I-2

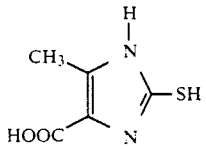

-continued

I-3

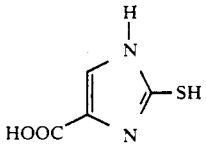

I-4

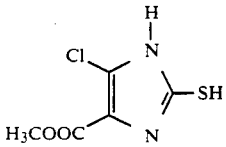

I-5

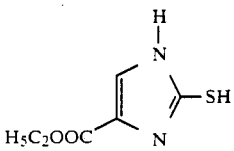

I-6

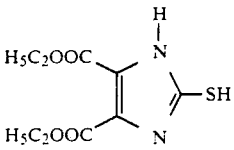

I-7

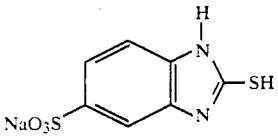

I-8

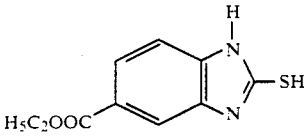

I-9

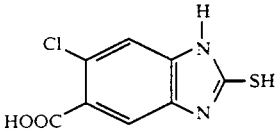

I-10

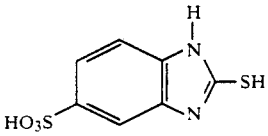

I-11

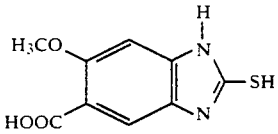

I-12

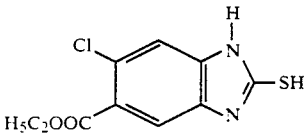

I-13

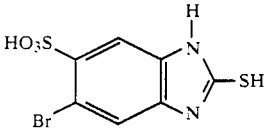

-continued

I-14

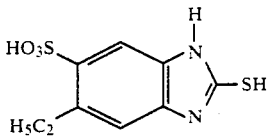

The following are the examples of the compound represented by Formulas II-a and II-b:

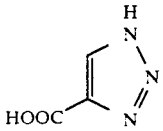

II-1

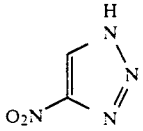

II-2

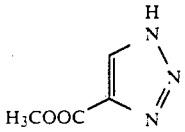

II-3

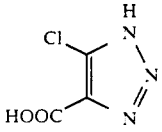

II-4

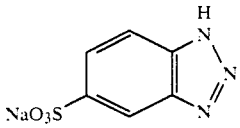

II-5

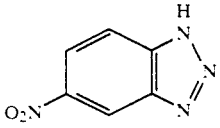

II-6

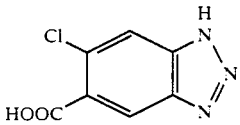

II-7

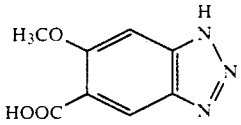

II-8

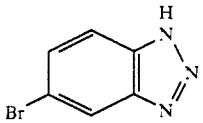

II-9

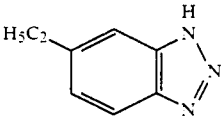

II-10

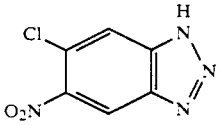

II-11

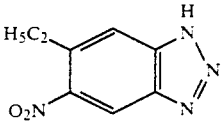

II-12

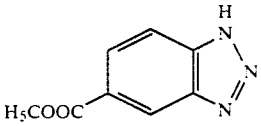

II-13

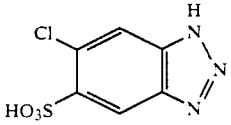

II-14

The above exemplified compounds can be produced by conventional methods such as the reaction of diamine compounds with carbon dioxide, as described in The Chemistry of Heterocyclic Compounds Imidazole and Derivatives, Vol.1, p.348; Ann, 325, 153 (1902), JACS, 71, 1436 (1949), JACS, 76, 4935 (1954), Berichte, 26,545, 2737 (1893), and J. Pract. Chem 125, 466 (1930).

At least one of the foregoing compounds is added to at least one of the photographic component layers such as a light-sensitive emulsion layer, non-light-sensitive emulsion layer, a protective layer, an intermediate layer and a filter layer.

In the invention, a coating liquid is stored while keeping warm after chemical ripening followed by the addition of various additives. A storing temperature of the coating liquid is 35° C. to 60° C., and a storing time is at least 12 hours, normally 3 to 8 hours.

Timing of adding the compound represented by Formula I or II may be either before or after the addition of various additives as long as it is before coating.

An adding amount thereof is 0.001 g to 10 g, and preferably 0.005 g to 2 g/mole AgX. When adding to the layers other than the emulsion layer, the adding amount can be determined based on that in the emulsion layer. The compound may be added in a solution of water or a hydrophilic organic solvent such as methanol and ethanol.

The compounds of Formulas I and II may be used alone or in combination, and may be different by layer. The compounds may be used in combination with other additives.

The silver halide emulsion used in the invention may be appropriately fogged by adding a reducing agent and a gold compound. A better fog can be provided to the emulsion by adding at least one of thiosulfates and thiocyanates together with the reducing agent and gold compound or by incorporating at least one of thiosulfates and thiocyanates into the emulsion fogged beforehand by the reducing agent and gold compound.

A good reversal characteristic of the light-sensitive material can be obtained by adding a water-soluble iodide before providing a fog thereto in the above manner. Examples of the water-soluble iodide are iodides of ammonium, potassium, lithium and sodium. An adding amount thereof is I to I0 millimole per mole of silver halide. If the amount is smaller than the above range, no satisfactory reversal characteristic is obtained. If the amount exceeds the above range. a sufficient maximum density can not be obtained, and the density is liable to lower by storage of the emulsion. In fogging the silver halide, pH is normally 5.5 to 9, and preferably 6 to 7; pAg is normally 6.5 to 8.5; and a temperature is normally 40° C. to 100° C., and preferably 50° C. to 70° C.

An amount of a hydrophilic colloid such as gelatin for suspending silver halide grains in fogging is preferably 30 to 200 g per mole of silver halide.

The examples of the reducing agent used in the invention are aldehyde compounds such as formalin: organic amine compounds such as hydrazine, triethylenetetramine, thiourea dioxide and imino-amino-methanesulfinic acid: inorganic reducing agents such as stannous chloride: and amine-borane.

An addition amount thereof is generally 0.001 to 100 millimole per mole of silver halide.

The gold compound used in the invention is a monovalent or trivalent water-soluble gold salt such as chloroauric acid. gold thiocyanate, sodium chloroaurate, potassium aurocyanide and potassium aurothiocyanide.

A using amount thereof is generally 0.0001 to 0.1 millimole, and preferably 0.005 to 0.05 millimole per mole of silver halide. When the reducing agent is used in a lower concentration, better results can be obtained.

The examples of the thiosulfate and thiocyanate used in the invention are sodium thiosulfate, ammonium thiosulfate, potassium thiocyanate, ammonium thiocyanate, and complexes thereof. These compounds are used generally in an amount of 0.0003 to 10.0 millimoles, and preferably 0.005 to 0.5 millimole per mole of silver halide. Adding time of the above compounds may be before, during or after fogging the emulsion with the reducing agent and gold compound. An addition amount thereof varies by addition timing. Particularly, it is necessary to increase the amount thereof when added after fogging.

To the direct positive silver halide emulsion of the invention may be added other photographic additives such as stabilizer, hardener, sensitizer, couplers, and others. Examples of the stabilizer are triazoles, azaindenes, benzothiazolium compounds, mercapto compounds, and water-soluble inorganic salts of cadmium, cobalt, nickel, manganese and zinc. Examples of the hardener are aldehydes such as formalin: S-triazines, epoxy compounds, azyridines and vinylsulfonic acid. Examples of the sensitizer are polyalkylene oxides and derivative thereof. Further, there may also be added a brightening agent, a thickner, a preservative and a matting agent.

The silver halide emulsion used in the invention may contain a hydrophilic polymer as a protective colloid, such as gelatin, gelatin derivatives, polyvinyl alcohol, polyvinyl acrylate, polyvinyl pyrrolidone, and cellulose ethers. Further, the emulsion may also contain a dispersion polymerization vinyl polymer as a binder. The supports used in the invention are glass; metal; plastic films such as cellulose acetate, polyester, and polyamide; baryta paper; and paper coated with polyolefin. The polyolefin-coated paper may be subjected to electron impact treatment to improve an adhesiveness thereof with an emulsion.

The direct positive silver halide light-sensitive material of the invention can be processed in accordance with conventional methods. A black-and-white developer used therefor may be a usual one containing a single or combined developing agents such as hydroquinone, 1-phenyl-3-pyrazolidone, N-methyl-p-aminophenol and p-phenylenediamine. Other conventional additives may be used. The light-sensitive material for color photography may be subjected to color development in accordance with a conventional color developing method.

A developer containing an aldehyde hardener may also be used.

In the invention, the whole processing time is defined by the period of time required for a light-sensitive material to travel from the first roller at an inlet of an automatic processor through the developer, fixer and washing baths up to the final roller at the outlet of the drying section.

The whole processing time is 20 to 60 seconds, and preferably not longer than 50 seconds.

The processing temperature is not more than 60° C., and preferably 20°to 45° C.

The following is an example of the breakdown of the whole processing time.

| Processing step | Temperature (°C.) | Time (sec.) |
|---|---|---|
| Insertion | — | 1.2 |
| Developing + crossover | 35 | 14.6 |
| Fixation + crossover | 33 | 8.2 |
| Washing + crossover | 25 | 7.2 |
| Squeeze | 40 | 5.7 |
| Drying | 45 | 8.1 |

-continued

| Processing step | Temperature (°C.) | Time (sec.) |
|---|---|---|
| Total | — | 45.0 |

EXAMPLES

The present invention is illustrated further in detail by the following examples.

EXAMPLE 1

A monodisperse emulsion was prepared in accordance with the following prescription.

| | |
|---|---|
| Solution A | |
| Gelatin | 26 g |
| Water | 900 ml |
| Solution B | |
| Silver nitrate | 170 g |
| Ammonia water (28%) | Equivalent amount |
| Water | 500 mg |
| Solution C | |
| Potassium bromide | 4.0 g |
| Potassium iodide | 3.5 g |
| Rhodium trichloride | 42 mg |
| Water | 30 ml |
| Solution D | |
| Potassium bromide | 145 g |
| Water | 500 mg |
| Liquid E | Amount necessary to adjust pH to 6.0 |
| Acetic acid | |

Solution A was kept at 40° C. in a reactor for emulsion preparation. To Solution A at 40° C. were added 1/10 of Solution B and Solution C simultaneously in 15 minutes with stirring by a propeller-type stirrer at 300 r.p.m. Next, 9/10 of Solution B and Solution D were added thereto by a double jet method while controlling an adding rate.

The above grain forming process was followed by a desalting process for removing the excessive salts.

The silver halide emulsion obtained above was kept at 40° C., and to the emulsion were added 5 g/mol AgX of sodium naphthalenesulfonate-formaldehyde condensation polymer (average polymerization degree 4 to 6) and 8 g/mol AgX of $MgSO_4$ and stirred for 5 minutes. Then, the emulsion was allowed to stand for a while. The supernatant was decanted for desalting, and the solution quantity was subjected to 200 ml per mol of silver halide. Next, pure water of 40° C. was added in an amount of 1.8 liter/mol AgX and the emulsion was stirred for 5 minutes.

Subsequently, 20 g/mol AgX of $MgSO_4$ were added to carry out desalting similarly.

The emulsion was stirred to redisperse silver halide, and gelatin was added for dispersing at 55° C.

After adjusting pH to 6.8, a prescribed amount of potassium iodide was added thereto. Then, 0.5 mg/mol AgX of thiourea dioxide, 2.7 mg/mol AgX of chloroauric acid and 2.1 mg/mol AgX of sodium thiosulfate were added at 60° C., and the emulsion was ripened until a prescribed fog was obtained.

To the ripened emulsion were added the following additives and the electron-accepting compounds as shown in Table 1, whereby emulsion coating liquids were prepared.

The emulsion coating liquid and a protective layer coating liquid hereinafter described were simultaneously coated at a speed of 70 m/min in the amounts of 2.3 g silver/$m^2$ and 0.98 g/$m^2$, respectively, and the coated layers were dried in 2 minutes and 25 seconds, whereby Samples No. 1 to 18 given in Table 1 were prepared.

| | per liter |
|---|---|
| Emulsion coating liquid composition | |
| Lime-treated osein gelatin | 51 g |
| 4-Hydroxy-6-methyl-1,3,3a,7-tetrazaindene | 1.2 g |
| Silver halide emulsion (silver equivalent) | 0.6 mol |
| 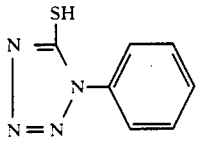 | 0.015 g |
| Nitron | 0.05 g |
| Styrene-butadien copolymer particles (average particle size: 0.03 μm) | 2.5 g |
| Styrene-maleic acid copolymer | 1.5 g |
| 2,2-Dihydroxymethyl-1-butanol | 7.0 g |
| 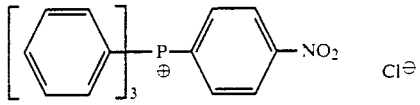 | 8 g |
| Protective layer coating liquid | |
| Lime-treated inert gelatin | 68 g |
| Acid-treated gelatin | 2 g |
| 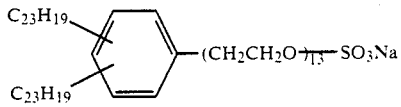 | 1.5 g |
| 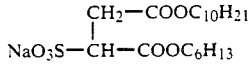 | 1.0 g |
| 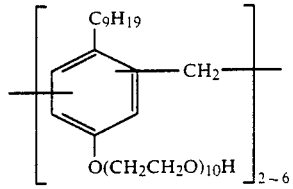 | 3.0 g |
| Fluorinated surfactant | added as shown in Table 1 |
| Ludox AM (colloidal silica, produced by DuPont) | 30 g |
| Polymethyl methacrylate particles (average particle size: 3.5 μm) | 1.2 g |

Each of the samples was exposed through an optical wedge and processed for 45 seconds with a developer XD-SR and a fixer XF-SR in an automatic processor SRX-501 manufactured by KONICA Corporation, and a sensitivity and a minimum density of each sample were measured. The results are shown in Table 1. The sensitivity is a reciprocal of the exposure required to give an optical density of 1.0 exclusive of the base density and the minimum density of the sample and shown in a relative value to that of Sample No. 1, which is set at 100.

A degree of static marks, a surface resistance and a coating evenness of each sample were measured.

Static marks

Each sample was left standing in a darkroom for 12 hours under the condition of 25° C./20% RH, and then the surface thereof was rubbed with a neoprene rubber roll under the same condition. After that, the sample was processed with XD-90 developer in GX-300 autoprocessor, both manufactured by KONICA Corporation, and the degree of the static marks was evaluated. The results are shown in Table 1. The degree was classified to the following four grades:

A: No static marks

B: static marks less than 3% by area

C: Static marks 3% to 10% by area

D: Static marks 10% or more by area

Surface resistance

A test piece of each sample was nipped with 10 cm-long brass electrodes having a gap of 0.14 cm, and a one-minute value was measured with an insulation tester TR8651 manufactured by Takeda Riken Co. The surface resistance was measured after the sample was left standing under the same condition as the above.

Coating evenness

Each sample was visually examined.

TABLE 1

| Sample No. | Electron-accepting compound No. | Electron-accepting compound mg/mol AgX | Fluorinated surfactant No. | Fluorinated surfactant mg/m$^2$ | Sensitivity | Minimum density | Antistatic characteristic: Static marks | Antistatic characteristic: Surface resistance | Coating evenness |
|---|---|---|---|---|---|---|---|---|---|
| 1 (Comp.) | — | | 2-8 | None | 100 | 0.09 | D | $5 \times 10^{11}\Omega$ | Good |
| 2 (Comp.) | 17 | 400 | 2-8 | None | 154 | 0.01 | D | $5 \times 10^{11}$ | " |
| 3 (comp.) | — | | F-1 | 4.2 | 98 | 0.12 | C | $3 \times 10^{13}$ | " |
| 4 (Comp.) | — | | F-2 | 4.2 | 101 | 0.10 | D | $3 \times 10^{13}$ | " |
| 5 (Comp.) | 17 | 400 | F-10 | 4.2 | 145 | 0.01 | C | $3 \times 10^{13}$ | " |
| 6 (Comp.) | — | | F-26 | 2.8 | 102 | 0.09 | C | $8 \times 10^{11}$ | " |
| 7 (Comp.) | — | | F-26 | 8.4 | 99 | 0.08 | B | $6 \times 10^{11}$ | Bad |
| 8 (Inv.) | 17 | 400 | F-3 | 16.8 | 150 | 0.00 | A | $6 \times 10^{11}$ | Good |
| 9 (Comp.) | — | | F-3 | 16.8 | 103 | 0.09 | A | $6 \times 10^{11}$ | " |
| 10 (Inv.) | 17 | 400 | F-34 | 16.8 | 152 | 0.00 | A | $7 \times 10^{11}$ | " |
| 11 (Inv.) | 10 | 300 | F-34 | 16.8 | 132 | 0.00 | A | $7 \times 10^{11}$ | " |
| 12 (Inv.) | 18 | 100 | F-34 | 16.8 | 147 | 0.01 | A | $7 \times 10^{11}$ | " |
| 13 (Inv.) | 10 | 300 | F-35 | 16.8 | 135 | 0.01 | A | $6 \times 10^{11}$ | " |
| 14 (Comp.) | — | | F-35 | 16.8 | 104 | 0.10 | A | $6 \times 10^{11}$ | " |
| 15 (Inv.) | 18 | 100 | F-28 | 16.8 | 143 | 0.00 | A | $6 \times 10^{11}$ | " |
| 16 (Comp.) | — | | F-28 | 16.8 | 98 | 0.11 | A | $6 \times 10^{11}$ | " |
| 17 (Inv.) | 17 | 400 | F-38 | 16.8 | 156 | 0.01 | A | $7 \times 10^{11}$ | " |
| 18 (Inv.) | 10 | 300 | F-38 | 16.8 | 137 | 0.02 | A | $7 \times 10^{11}$ | " |

As is apparent from Table 1, the samples of the invention have higher sensitivities, lower minimum densities and more excellent antistatic characteristic than those of the comparative samples.

EXAMPLE 2

A monodisperse emulsion was prepared with Solutions A, B, C, D and E of the same compositions in the same manner as in Example 1, provided that rhodium trichloride in Solution C was replaced with hexachloroiridium acid potassium salt of the same amount.

The emulsion was desalted and ripened for fogging in the same manner as in Example 1.

The same additives and spectral sensitizers as those in Example 1 were added to the above emulsion to prepare emulsion coating liquids. Further, there was prepared a protective layer coating liquid of the same composition as in Example 1. Both liquids were coated simultaneously in the same amounts of silver and gelatin in the same manner as in Example 1, whereby Samples No. 19 to No. 32 given in Table 2 were prepared. These samples were tested and evaluated in the same manner as in Example 1, provided that the sensitivity is a relative value to that of Sample No. 19, which is set at 100.

TABLE 2

| Sample No. | Electron-accepting compound No. | Electron-accepting compound mg/mol AgX | Fluorinated surfactant No. | Fluorinated surfactant mg/m$^2$ | Sensitivity | Minimum density | Antistatic characteristic: Static marks | Antistatic characteristic: Surface resistance | Coating evenness |
|---|---|---|---|---|---|---|---|---|---|
| 19 (Comp.) | — | — | 2-8 | None | 100 | 0.11 | D | $5 \times 10^{11}$ | Good |
| 20 (Inv.) | 17 | 400 | F-1 | 4.2 | 152 | 0.02 | D | $3 \times 10^{13}$ | " |
| 21 (comp.) | — | — | F-10 | 4.2 | 104 | 0.13 | C | $3 \times 10^{13}$ | " |
| 22 (Comp.) | — | — | F-26 | 8.4 | 95 | 0.09 | B | $6 \times 10^{11}$ | bad |
| 23 (Inv.) | 17 | 400 | F-3 | 16.8 | 147 | 0.01 | A | $6 \times 10^{11}$ | Good |
| 24 (Comp.) | — | — | F-3 | 16.8 | 92 | 0.09 | A | $6 \times 10^{11}$ | " |
| 25 (Inv.) | 17 | 400 | F-34 | 16.8 | 139 | 0.00 | A | $7 \times 10^{11}$ | " |
| 26 (Inv.) | 10 | 300 | F-34 | 16.8 | 161 | 0.01 | A | $7 \times 10^{11}$ | " |
| 27 (Inv.) | 17 | 400 | F-35 | 16.8 | 158 | 0.00 | A | $6 \times 10^{11}$ | " |
| 28 (Inv.) | 18 | 100 | F-35 | 16.8 | 143 | 0.01 | A | $6 \times 10^{11}$ | " |
| 29 (Comp.) | — | — | F-35 | 16.8 | 98 | 0.13 | A | $6 \times 10^{11}$ | " |
| 30 (Inv.) | 17 | 400 | F-28 | 16.8 | 152 | 0.01 | A | $6 \times 10^{11}$ | " |
| 31 (Inv.) | 17 | 300 | F-28 | 16.8 | 141 | 0.02 | A | $6 \times 10^{11}$ | " |
| 32 (Comp.) | — | — | F-38 | 16.8 | 102 | 0.09 | A | $7 \times 10^{11}$ | " |

As is apparent from Table 2, the samples of the invention have higher densities, lower minimum densities (reversal fog) and more excellent antistatic characteristic than those of the comparative samples.

EXAMPLE 3

A monodisperse emulsion was prepared in accordance with the following prescription.

| | |
|---|---|
| Solution A | |
| Gelatin | 8 g per mol of AgX |
| Hexachloroiridium (III) acid potassium salt | 42 g per mol of AgX |
| Water | 500 ml per mol of AgX |
| Solution B | |
| Silver nitrate | 170 g per mol of AgX |
| Ammonia water (28%) | equivalent |
| Water | 210 ml per mol of AgX |
| Solution C | |
| Potassium bromide | 120 g per mol of AgX |
| Potassium iodide | 3.5 g per mol of AgX |
| Water | 210 ml per mol of AgX |
| Solution D | Amount necessary to adjust pH |
| Acetic acid | to 6.0 |

To Solution A kept at 40° C. in a reactor were added Solutions B and C simultaneously in 15 minutes by a double-jet method.

Next, the emulsion was desalted and ripened in the same manner as in Example 1.

After completion of ripening, there were added electron-accepting compounds and the compounds of Formulas I and II as shown in Table 3 and further the following additives to thereby prepare emulsion coating liquids, which were sampled every standing time of 0, 3 and 8 hours while keeping at 40° C. there were coated simultaneously each of the sampled emulsion coating liquids in a silver amount of 2 g/m$^2$ and the following protective layer coating liquid in a gelatin amount of 1.20 g/m$^2$, whereby Samples No. 33 to 59 were prepared.

| | per liter |
|---|---|
| Emulsion coating liquid | |
| Lime-treated osein gelatin | 51 g |
| Silver halide emulsion (converted to silver) | 0.6 mol |
| 1-Phenyl-5-mercaptotetrazole | 0.015 g |
| Nitron | 0.05 g |
| Styrene-maleic acid copolymer | 1.5 g |
| 2,2-Dihydroxymethyl-1-butanol | 8 g |
| p-Nitrophenyltriphenylphosphonium chloride | 2 g |
| 1,1-Dimethylol-1-bromo-1-nitromethane | 30 mg |
| Protective layer coating liquid | |
| Lime-treated inert gelatin | 68 g |
| Acid-treated gelatin | 2 g |
| 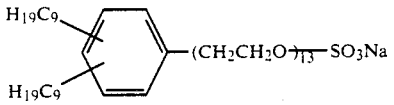 | 1.5 g |
| 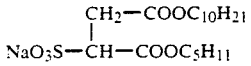 | 1.0 g |
| Ludox AM (collidal silica, product of DuPont) | 30 g |
| Polymethyl methacrylate particles (average particle size: 3.5 μm) | 1.2 g |
| Sodium 2,4-dichloro-6-hydroxy-1,3,5-triazine (2% aqueous solution) | 5 ml |
| Glyoxal (40% solution) | 1 ml |

-continued

| | per liter |
|---|---|
| 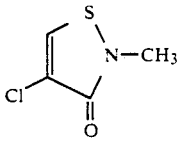 | 10 mg |

Further, the fluorinated surfactants and comparative surfactants were added as shown in Table 3.

A

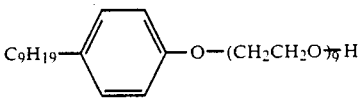

B

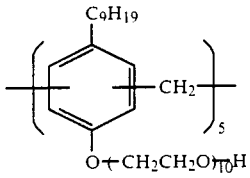

C

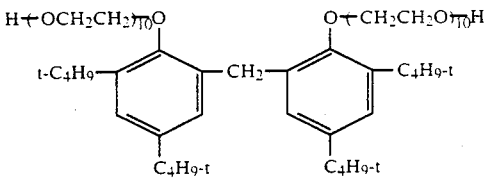

Each sample was exposed through a sensitometry wedge, and processed with a developer and a fixer of the following compositions in an automatic processor SRX-501, manufactured by KONICA Corporation, in which the total processing time was 45 seconds.

For processing evenness evaluation, a 8×10-size piece of each sample was overall exposed and subjected to the above processing.

There were evaluated a sensitivity, a maximum density and fog (the minimum density of reversal image) and a processing evenness of each sample. The sensitivity is a relative value to that of Sample No. 33 with the standing time of zero, which is set at 100.

Processing evenness grades

5: Excellent
4: Good
3: Normal
2: Poor
1: Bad

The results are shown in Table 3.

| Compositions of developer and fixer | |
|---|---|
| Developer | |
| Potassium sulfite | 55.0 g |
| Hydroquinone | 25.0 g |
| 1-Phenyl-3-pyrazolidone | 1.2 g |
| Boric acid | 10.0 g |
| Sodium hydroxide | 21.0 g |
| Triethylene glycol | 17.5 g |
| 5-nitrobenzimidazole | 0.10 g |
| Glutaraldehyde bisulfite | 15.0 g |
| Glacial acetic acid | 16.0 g |
| Potassium bromide | 4.0 g |
| Triethylenetetraminhexaacetic acid | 2.5 g |
| Water to make 1 liter. | |

-continued

| Compositions of developer and fixer | |
|---|---|
| Fixer | |
| Ammonium thiosulfate | 130.9 g |
| Sodium sulfite anhydrous | 7.3 g |
| Boric acid | 7.0 g |
| Acetic acid (90 wt %) | 5.5 g |
| Disodium ethylenediaminetetraacetate | 3.0 g |
| Sodium acetate trihydrate | 25.8 g |
| Aluminum sulfate octadecahydrate | 14.6 g |
| Sulfuric acid (50 wt %) | 6.77 g |
| Water to make 1 liter. | |

As is apparent from Table 3, the samples of the invention have higher sensitivities and less minimum densities than those of the comparative samples, and have no changes in the sensitivities and minimum densities even when the standing time is long.

Further, it can be found that the fluorinated surface active agents prevent the light-sensitive material from processing unevenness even when subjected to rapid processing, and provide an excellent processability thereto.

TABLE 3

| Sample No. | Electron-accepting compound | | Compound of Formula I, II | | Surfactant | |
|---|---|---|---|---|---|---|
| | No. | Amt. (mg/mol AgX) | No. | Amt. (mg/mol AgX) | No. | Amt (mg/m$^2$) |
| 33 (Comp.) | — | — | None | — | None | — |
| 34 (Comp.) | 17 | 400 | None | — | None | — |
| 35 (Comp.) | 10 | 400 | None | — | None | — |
| 36 (Comp.) | 18 | 400 | None | — | None | — |
| 37 (Comp.) | — | — | I-1 | 60 | None | — |
| 38 (Comp.) | — | — | I-7 | 60 | None | — |
| 39 (Inv.) | 17 | 400 | I-1 | 60 | None | — |
| 40 (Inv.) | 17 | 400 | I-4 | 60 | A | 100 |
| 41 (Inv.) | 17 | 400 | II-5 | 60 | B | 100 |
| 42 (Inv.) | 17 | 400 | I-12 | 60 | C | 100 |
| 43 (Inv.) | 17 | 400 | I-7 | 60 | F-6 | 100 |
| 44 (Inv.) | 17 | 1000 | II-10 | 60 | F-6 | 100 |
| 45 (Inv.) | 17 | 400 | II-10 | 60 | F-6 | 100 |
| 46 (Inv.) | 17 | 50 | II-10 | 60 | F-6 | 100 |
| 47 (Inv.) | 10 | 400 | I-1 | 60 | F-18 | 100 |
| 48 (Inv.) | 10 | 400 | I-9 | 60 | F-20 | 100 |
| 49 (Inv.) | 10 | 400 | II-6 | 5 | F-28 | 100 |
| 50 (Inv.) | 10 | 400 | II-6 | 60 | F-28 | 100 |
| 51 (Inv.) | 10 | 400 | II-6 | 200 | F-28 | 100 |
| 52 (Inv.) | 18 | 400 | I-3 | 60 | F-31 | 100 |
| 53 (Inv.) | 18 | 400 | I-10 + II-10 | 30 + 30 | F-31 | 100 |
| 54 (Inv.) | 18 | 400 | I-7 + II-12 | 20 + 50 | F-12 | 100 |
| 55 (Inv.) | 18 | 400 | I-10 + II-10 | 30 + 30 | F-10 | 100 |
| 56 (Inv.) | 17 + 10 | 200 + 200 | II-5 | 60 | F-10 | 100 |
| 57 (Inv.) | 17 + 10 | 100 + 300 | II-12 | 60 | F-20 | 100 |
| 58 (Inv.) | 10 + 18 | 200 + 200 | II-12 | 60 | F-20 | 100 |
| 59 (Inv.) | 10 + 18 | 200 + 200 | I-10 + II-5 | 30 + 30 | F-26 | 100 |

| Sample No. | Standing time zero | | | | Standing time 3 hours | | | | Standing time 8 hours | | | |
|---|---|---|---|---|---|---|---|---|---|---|---|---|
| | Sensitivity | fog | Dmax | processing evenness | Sensitivity | fog | Dmax | Processing evenness | Sensitivity | Fog | Dmax | Processing evenness |
| 33 (Comp.) | 100 | 0.12 | 3.17 | 2 | 105 | 0.15 | 3.00 | 2 | 118 | 0.25 | 2.51 | 1 |
| 34 (Comp.) | 154 | 0.05 | 3.20 | 3 | 140 | 0.06 | 3.10 | 3 | 120 | 0.09 | 2.60 | 2 |
| 35 (Comp.) | 147 | 0.06 | 3.20 | 2 | 137 | 0.07 | 3.12 | 2 | 111 | 0.10 | 2.55 | 1 |
| 36 (Comp.) | 144 | 0.06 | 3.14 | 2 | 135 | 0.08 | 3.00 | 2 | 110 | 0.10 | 2.58 | 1 |
| 37 (Comp.) | 99 | 0.08 | 3.20 | 3 | 97 | 0.08 | 3.12 | 3 | 96 | 0.09 | 2.88 | 2 |
| 38 (Comp.) | 101 | 0.08 | 3.21 | 3 | 97 | 0.08 | 3.13 | 3 | 95 | 0.08 | 2.89 | 2 |
| 39 (Inv.) | 152 | 0.04 | 3.21 | 4 | 150 | 0.04 | 3.18 | 4 | 147 | 0.05 | 3.15 | 4 |
| 40 (Inv.) | 152 | 0.04 | 3.18 | 4 | 150 | 0.04 | 3.16 | 4 | 148 | 0.05 | 3.12 | 4 |
| 41 (Inv.) | 152 | 0.04 | 3.18 | 4 | 149 | 0.04 | 3.15 | 4 | 147 | 0.04 | 3.12 | 4 |
| 42 (Inv.) | 153 | 0.04 | 3.19 | 4 | 150 | 0.04 | 3.16 | 4 | 147 | 0.05 | 3.12 | 4 |
| 43 (Inv.) | 152 | 0.02 | 3.18 | 5 | 152 | 0.02 | 3.15 | 5 | 150 | 0.02 | 3.14 | 5 |
| 44 (Inv.) | 164 | 0.03 | 3.23 | 5 | 162 | 0.03 | 3.18 | 5 | 161 | 0.03 | 3.15 | 5 |
| 45 (Inv.) | 152 | 0.03 | 3.18 | 5 | 151 | 0.03 | 3.14 | 5 | 148 | 0.03 | 3.11 | 5 |
| 46 (Inv.) | 132 | 0.03 | 3.09 | 5 | 132 | 0.03 | 3.04 | 5 | 130 | 0.03 | 3.02 | 5 |
| 47 (Inv.) | 147 | 0.03 | 3.18 | 5 | 147 | 0.03 | 3.16 | 5 | 149 | 0.03 | 3.14 | 4 |
| 48 (Inv.) | 147 | 0.03 | 3.17 | 5 | 147 | 0.03 | 3.15 | 5 | 152 | 0.03 | 3.14 | 4 |
| 49 (Inv.) | 146 | 0.03 | 3.17 | 5 | 146 | 0.03 | 3.14 | 5 | 140 | 0.05 | 3.10 | 5 |
| 50 (Inv.) | 147 | 0.03 | 3.17 | 5 | 147 | 0.03 | 3.15 | 5 | 146 | 0.03 | 3.14 | 5 |
| 51 (Inv.) | 150 | 0.05 | 3.18 | 4 | 150 | 0.05 | 3.16 | 4 | 150 | 0.06 | 3.14 | 4 |
| 52 (Inv.) | 143 | 0.05 | 3.16 | 5 | 143 | 0.05 | 3.16 | 5 | 143 | 0.05 | 3.16 | 5 |
| 53 (Inv.) | 144 | 0.03 | 3.16 | 5 | 144 | 0.03 | 3.16 | 5 | 144 | 0.03 | 3.16 | 5 |
| 54 (Inv.) | 144 | 0.03 | 3.16 | 5 | 144 | 0.03 | 3.16 | 5 | 144 | 0.03 | 3.16 | 5 |
| 55 (Inv.) | 143 | 0.03 | 3.17 | 5 | 143 | 0.03 | 3.17 | 5 | 143 | 0.03 | 3.17 | 5 |
| 56 (Inv.) | 162 | 0.02 | 3.24 | 5 | 162 | 0.02 | 3.24 | 5 | 162 | 0.02 | 3.23 | 5 |
| 57 (Inv.) | 161 | 0.02 | 3.23 | 5 | 161 | 0.02 | 3.23 | 5 | 161 | 0.03 | 3.23 | 5 |
| 58 (Inv.) | 158 | 0.03 | 3.21 | 5 | 158 | 0.03 | 3.21 | 5 | 158 | 0.03 | 3.21 | 5 |
| 59 (Inv.) | 155 | 0.03 | 3.21 | 5 | 155 | 0.02 | 3.21 | 5 | 155 | 0.03 | 3.21 | 5 |

EXAMPLE 4

The samples of standing time 3 hours in Example 3 were exposed in the same manner as in Example 3, and processed with the following developer and fixer by an automatic processor SRX in the total processing time of 45 seconds.

| | |
|---|---|
| Developer | |
| Potassium hydroxide | 24 g |
| Sodium sulfite | 40 g |
| Potassium sulfite | 50 g |
| Diethylenetriaminepentaacetic acid | 2.4 g |
| Boric acid | 10 g |
| Hydroquinone | 35 g |
| Diethylene glycol | 11.2 g |
| 4-Hydroxymethyl-4-methyl-1-phenyl-3-pyrazolidone | 1.0 g |
| 5-Methylbenzotriazole | 0.06 g |
| Potassium bromide | 2 g |
| 1-Phenyl-3-pyrazolidone | 0.5 g |
| Water to make 1 liter. Adjust pH to 10.5. | |
| Fixer | |
| Ammonium thiosulfate | 140 g |
| Sodium sulfite | 15 g |
| Disodium ethylenediaminetetraacetate | 0.025 g |
| Sodium hydroxide | 6 g |
| Water to make 1 liter. | |
| Adjust pH to 5.10 with acetic acid. | |

The sensitivity, maximum density, minimum density and processing evenness of each processed sample were evaluated in the same manner as in Example 3.

The results are shown in Table 4.

TABLE 4

| Sample No. | Electron-accepting cpd. No. | Electron-accepting cpd. Amt (mg/mol AgX) | Compound of Formula I, II No. | Compound of Formula I, II Amt (mg/mol AgX) | Surfactant No. | Surfactant Amt (mg/mol AgX) | Standing time 3 hours Sensitivity | fog | Dmax | Evenness |
|---|---|---|---|---|---|---|---|---|---|---|
| 60 (Comp.) | None | — | None | — | None | — | 105 | 0.15 | 3.23 | 2 |
| 61 (Comp.) | None | — | I-1 | 60 | None | — | 100 | 0.08 | 3.25 | 3 |
| 62 (Inv.) | 17 | 400 | I-1 | 60 | None | — | 153 | 0.04 | 3.27 | 4 |
| 63 (Inv.) | 17 | 400 | I-4 | 60 | A | 100 | 155 | 0.04 | 3.25 | 4 |
| 64 (Inv.) | 17 | 400 | I-7 | 60 | F-6 | 100 | 156 | 0.02 | 3.25 | 5 |
| 65 (Inv.) | 10 | 400 | I-9 | 60 | F-20 | 100 | 151 | 0.03 | 3.24 | 5 |
| 66 (Inv.) | 10 | 400 | II-6 | 60 | F-28 | 100 | 149 | 0.03 | 3.24 | 5 |
| 67 (Inv.) | 18 | 400 | I-3 | 60 | F-31 | 100 | 146 | 0.05 | 3.23 | 5 |
| 68 (Inv.) | 18 | 400 | I-10 + II-10 | 30 + 30 | F-10 | 100 | 146 | 0.03 | 3.24 | 5 |
| 69 (Inv.) | 17 + 10 | 100 + 300 | II-12 | 60 | F-20 | 100 | 164 | 0.02 | 3.29 | 5 |
| 70 (Inv.) | 10 + 18 | 200 + 200 | I-10 + II-5 | 30 + 30 | F-26 | 100 | 157 | 0.02 | 3.28 | 5 |

As is apparent from Table 4, the samples of the invention which were processed in a developer and a fixer of the above compositions showed the same effect as in Example 1, particularly an excellent effect to the sensitivity.

What is claimed is:

1. A direct positive silver halide photographic light-sensitive material comprising a support having provided thereon photographic component layers including a silver halide emulsion layer, wherein said silver halide emulsion layer contains prefogged silver halide grains and an electron-accepting compound; at least one of said photographic component layers containing at least one compound selected from the group consisting of Formula I-a

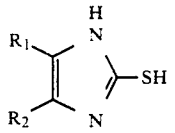

Formula I-b

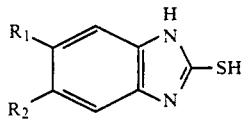

Formula II-a

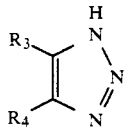

Formula II-b

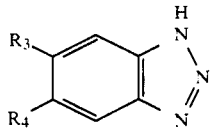

wherein $R_1$ to $R_4$ independently represent a hydrogen atom, a lower alkyl group, an alkoxy group, a carboxyl group, an alkoxycarbonyl group, a sulfo group, a halogen atom, and a nitro group, provided that at least one of $R_1$ and $R_2$ is a carboxyl group, an alkoxycarbonyl group, or a sulfo group.

2. The light-sensitive material of claim 1 wherein at least one of said photographic component layers further contains a fluorinated surfactant.

3. The light-sensitive material of claim 1, wherein the electron-accepting compound is represented by one of the following Formulas IV to VIII:

Formula IV

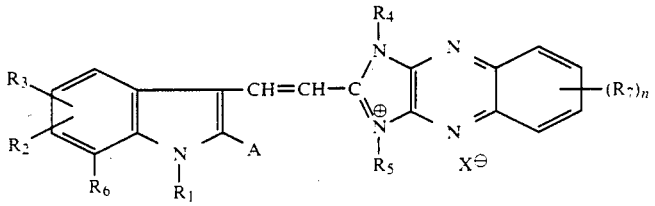

wherein A represents an aromatic nucleus or a heterocyclic aromatic nucleus; $R_1$ represents an alkyl group, a sulfoalkyl group, a sulfatoalkyl group, or a carboxyalkyl group; $R_2$, $R_3$ and $R_6$ represent independently a hydrogen atom, a halogen atom, an alkyl group and an alkoxy group, provided that $R_2$ and $R_3$ may combine with each other to form an aromatic ring; $R_4$ and $R_5$ represent independently an alkyl group, a sulfoalkyl group, a sulfatoalkyl group, a carboxyalkyl group, a hydroxyalkyl group, an allyl group, an alkenyl group, an alkynyl group, a cycloalkyl group, a dialkylaminoalkyl group, and an aryl group; $R_7$ represents a halogen atom or a nitro group; X represents an anion; and n represents an integer of 0 to 3;

Formula IV-a

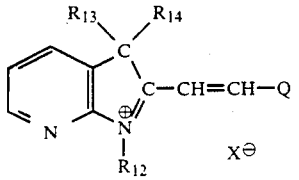

wherein $R_{12}$, $R_{13}$ and $R_{14}$ represent independently an alkyl group and an aryl group; X is the same as in Formula IV; and Q represents —CH=$Q_1$ in which $Q_1$ represents a desensitization nucleus forming a trimethine cyanine dye, or a desensitization nucleus forming a dimethine cyanine dye;

Formula V

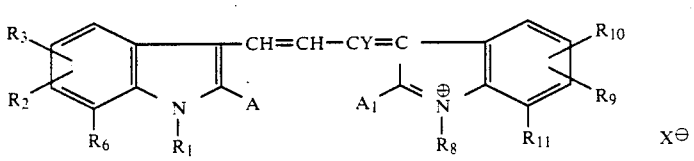

wherein $R_1$, $R_2$, $R_3$, $R_6$, X and A represent the same as those defined in Formula IV; $A_1$, $R_8$, $R_9$, $R_{10}$ and $R_{11}$ represent the same as those defined for A, $R_1$, $R_2$, $R_3$ and $R_6$, respectively; and Y represents a hydrogen atom, an aryl group, an alkyl group, an alkoxy group or a heterocyclic aromatic group;

Formula VI

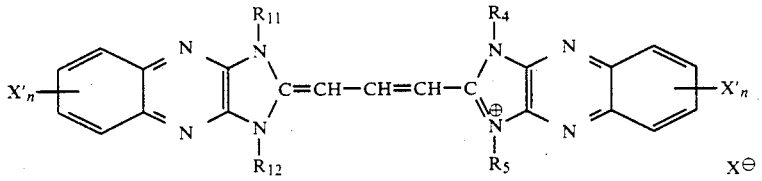

wherein $R_4$, $R_5$ and X represent the same as those defined in Formula IV; $R_{11}$ and $R_{12}$ represent the same as those defined for $R_4$ and $R_5$, respectively; X' represents a halogen atom; and n represents an integer of 0 to 3;

Formula VII

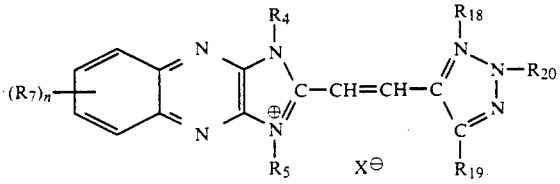

wherein $R_4$, $R_5$, $R_7$, X and n represent the same as those defined in Formula IV; $R_{18}$ and $R_{19}$ represent independently a hydrogen atom, an alkyl group and an aryl group; and $R_{20}$ represents the same as those defined for $R_4$;

Formula VIII

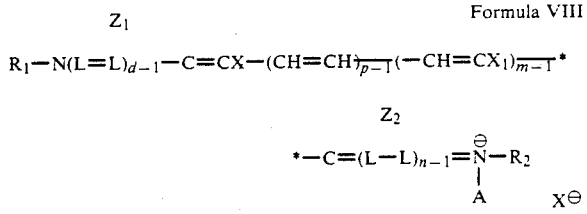

wherein $Z_1$ and $Z_2$ represent independently the group of nonmetallic atoms necessary to form a heterocyclic nucleus; X and $X_1$ represent independently a hydrogen atom and a halogen atom, provided that at least one of X and $X_1$ is chlorine, bromine or iodine; $R_1$ and $R_2$ represent independently an alkyl group, a sulfoalkyl group having 1 to 4 carbon atoms, and a carboxyalkyl group having 1 to 4 carbon atoms; A represents an acid anion; and d, m, n and p represent independently an integer of 1 and 2.

4. The light-sensitive material of claim 1, wherein the fluorinated surfactant is added to at least on of the silver halide emulsion layer, a protective layer and a backing layer in an amount of 0.1 mg to 20 g/m$^2$.

5. The light-sensitive material of claim 1, wherein at least one of the compounds represented by Formula I-a to II-b is added to at least one of a light-sensitive emulsion layer, a non-light-sensitive emulsion layer, an intermediate layer and a filter layer in an amount of 0.001 to 10 g/mol of silver halide.

6. The light-sensitive material of claim 1, wherein the silver halide emulsion contains an inorganic desensitizer in the silver halide grains.

7. The light-sensitive material of claim 6, wherein the inorganic desensitizer is a water-soluble salt of a Group VIII metal.

8. The light-sensitive material of claim 7, wherein the inorganic desensitizer is a water-soluble salt of rhodium or inidium.

9. The light-sensitive material of claim 8, wherein a content of the inorganic desensitizer is $10^{-8}$ to $10^{-2}$ mol/mol of silver halide.

10. The light-sensitive material of claim 9, wherein the content is $10^{-5}$ to $10^{-3}$ mol/mol of silver halide.

11. The light-sensitive material of claim 6, wherein the silver halide grains comprise silver chloroiodide, silver bromoiodide or silver bromochloroiodide.

12. The light-sensitive material of claim 11, wherein an average content of silver iodide is 0.05 to 10 mol %.

13. The light-sensitive material of claim 12, wherein the content is 0.5 to 8 mol %.

14. The light-sensitive material of claim 11, wherein the silver halide grains comprise a portion where silver iodide of 20 mol % or more exists locally.

15. The light-sensitive material of claim 6, wherein the silver halide emulsion comprise core/shell type silver halide grains.

16. The light-sensitive material of claim 15, wherein the core of the grains comprises silver iodide, silver bromoiodide or silver bromochloroiodide.

17. The light-sensitive material of claim 16, wherein the core comprises silver bromoiodide containing silver bromide of 0 to 99 mol %.

18. The light-sensitive material of claim 15, wherein the shell of the grains comprises silver bromide or silver bromoiodide and has a smaller solubility product than that of the core.

19. The light-sensitive material of claim 3, wherein an addition amount of the electron-accepting compound is 10 mg to 2 g/mol of silver halide.

* * * * *